US005830633A

United States Patent [19]

Matsumoto

[11] Patent Number: 5,830,633

[45] Date of Patent: Nov. 3, 1998

[54] SILVER HALIDE EMULSION

[75] Inventor: Jun Matsumoto, Minami-ashigara, Japan

[73] Assignee: Fuji Photo Film Co., Ltd., Kanagawa, Japan

[21] Appl. No.: 290,307

[22] Filed: Aug. 12, 1994

Related U.S. Application Data

[63] Continuation of Ser. No. 19,909, Feb. 19, 1993, abandoned.

[30] Foreign Application Priority Data

Feb. 21, 1992 [JP] Japan ..... 4-070054

[51] Int. Cl.[6] ..... G03C 1/035; G03C 1/015

[52] U.S. Cl. ..... 430/567; 430/569

[58] Field of Search ..... 430/567, 569

[56] References Cited

U.S. PATENT DOCUMENTS

| | | | |
|---|---|---|---|
| 4,435,501 | 3/1984 | Maskasky | 430/567 |
| 4,463,087 | 7/1984 | Maskasky | 430/567 |
| 4,806,461 | 2/1989 | Ikeda et al. | 430/567 |
| 4,996,137 | 2/1991 | Inoue et al. | 430/567 |
| 5,068,173 | 11/1991 | Takehara et al. | 430/567 |

OTHER PUBLICATIONS

James, T.H., ed. "The Theory of the Photographic Process", 4th ed, MacMillan Publishing Co., Inc. 1977, pp. 19–20.

*Primary Examiner*—Mark F. Huff

[57] ABSTRACT

A silver halide emulsion contains silver halide grains formed of tabular silver halide grains having dislocations inside the grains, as host grains. A silver halide consisting essentially of silver bromide is epitaxially grown on the host grains.

3 Claims, 1 Drawing Sheet

SILVER HALIDE EMULSION

This application is a continuation of application Ser. No. 08/019,909 filed on Feb. 19, 1993, now abandoned.

BACKGROUND OF THE INVENTION

1. Field of the Invention

The present invention particularly relates to a light-sensitive silver halide emulsion having a high photographic sensitivity.

2. Description of the Related Art

Methods of manufacturing and techniques of using tabular silver halide grains (to be also referred to as simply "tabular grains" hereinafter) are disclosed in, e.g., U.S. Pat. Nos. 4,434,226, 4,439,520, 4,414,310, 4,433,048, 4,414,306, and 4,459,353. Known advantages of grains of this type are improvements in sensitivity including an improvement in spectral sensitization efficiency obtained by sensitizing dyes, improvements in sensitivity/graininess, and improvements in sharpness and covering power derived from specific optical properties of tabular grains. In recent years, however, with increasing sensitivities and decreasing format sizes of silver halide color light-sensitive materials, a strong demand has arisen for a color photographic light-sensitive material having a higher sensitivity and a higher image quality.

For this reason, a silver halide emulsion having a higher sensitivity and a better graininess has been required. However, conventional tabular silver halide grains are unsatisfactory to meet these requirements, and further improvements in performance have been desired.

Observation of dislocations in silver halide grains is described in, for example, the following literature:

(1) C. R. Berry, *J. Appl. Phys.,* 27, 636 (1956)

(2) C. R. Berry, D. C. Skilman, *J. Appl. Phys.,* 35, 2165 (1964)

(3) J. F. Hamilton, *J. Phot. Sci. Eng.,* 11, 57 (1967)

(4) T. Shiozawa, *J. Soc. Phot. Sci. Jap.,* 34, 16 (1971)

(5) T. Shiozawa, *J. Soc. Phot. Sci. Jap.,* 35, 213 (1972)

The above literature describes that it is possible to observe dislocations in a crystal by the use of an X-ray diffraction method or a low-temperature transmission electron microscopic method, and that various dislocations are produced in a crystal by intentionally applying distortion to the crystal.

In the above literature, dislocations are not intentionally introduced to silver halide grains during formation of photographic emulsions. Silver halide grains to which dislocations are positively introduced are described in JP-A-63-220238 ("JP-A" means Published Unexamined Japanese Patent Application) and JP-A-1-201649. These patents demonstrate that tabular grains to which dislocation lines are introduced to some extent are superior in sensitivity and reciprocity to those having no dislocation lines, and that light-sensitive materials using these tabular grains are excellent in sharpness and graininess. However, fog is undesirably increased in these light-sensitive materials.

Techniques to epitaxially grow silver bromide in a silver halide grain are disclosed in JP-A-55-163532, JP-A-58-108526, and JP-B-3-45809 ("JP-B" means Published Examined Japanese Patent Application). These patents show that the grains have high photographic sensitivities and high storage stabilities. However, the effect of obtaining grains having higher sensitivities is still unsatisfactory.

SUMMARY OF THE INVENTION

It is an object of the present invention to provide a silver halide emulsion having a high sensitivity and a low fog.

The above object of the present invention is achieved by a silver halide emulsion containing silver halide grains comprising tabular silver halide grains having dislocations inside the grains as host grains, and a silver halide consisting essentially of silver bromide, disposed, as a guest, on the host grains by epitaxial growth.

DETAILED DESCRIPTION OF THE PREFERRED EMBODIMENTS

Figure 1:
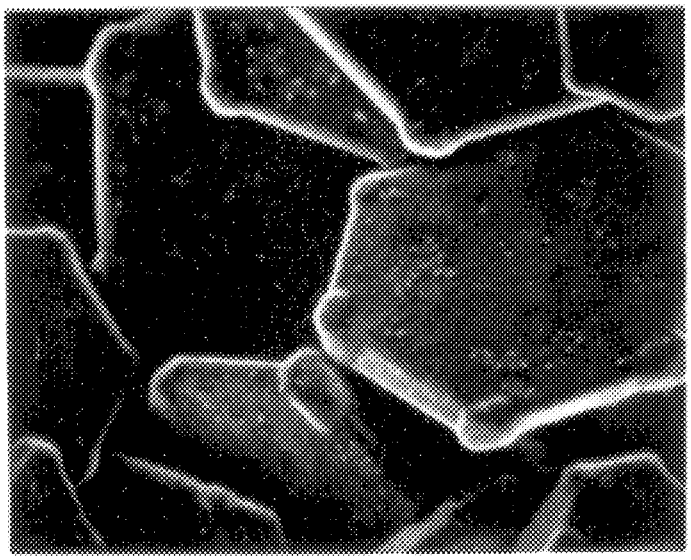
FIG. 1 is an electron micrograph (at ×30,000 magnification) showing a grain structure in which silver bromide is epitaxially grown at the corners of a tabular grain in an emulsion F of Example 1.

The present invention will be described in more detail below.

Host silver halide grains for use in the present invention are silver bromide, silver chloride, silver iodide, silver chlorobromide, silver iodochloride, silver bromoiodide, or silver bromochloroiodide. A silver salt other than these silver halides, e.g., silver rhodanide, silver sulfide, silver selenide, silver carbonate, silver phosphate, or an organic acid silver may be contained as another grain or a portion of the silver halide grain. Silver bromoiodide is more preferable, and an average iodide content is 1 to 30 mole %, preferably 2 to 15 mole %, and more preferably 5 to 12 mole %.

A value obtained by dividing the equivalent-circle diameter of a projected area by a grain thickness is called an aspect ratio which defines the shape of a tabular grain. Tabular grains having aspect ratios higher than 1 can be used in the present invention. Tabular grains can be prepared by the methods described in, e.g., Cleve, "Photography Theory and Practice" (1930), page 131; Gutoff, "Photographic Science and Engineering", Vol. 14, pages 248 to 257, (1970); and U.S. Pat. Nos. 4,434,226, 4,414,310, 4,433,048, and 4,439,520, and British Patent 2,112,157. The use of tabular grains brings about advantages, such as an increase in covering power and an increase in spectral sensitization efficiency due to sensitizing dyes. These advantages are described in detail in U.S. Pat. No. 4,434,226 cited above. An average aspect ratio of 80% or more of a total projected area of grains is preferably 1 to 100, more preferably 2 to 20, and most preferably 3 to 10. The shape of a tabular grain can be selected from, e.g., a triangle, a hexagon, and a circle. An example of a preferable shape is a hexagon having six substantially equal sides, as described in U.S. Pat. No. 4,797,354.

The equivalent-circle diameter of a projected area is often used to represent the grain size of a tabular grain. Grains having an average diameter of 0.6 $\mu$m or less, as described in U.S. Pat. No. 4,748,106, are preferable to improve image quality. An emulsion having a narrow grain size distribution, as described in U.S. Pat. No. 4,775,617, is also preferable. To increase sharpness, it is preferable to limit the grain size of a tabular grain to 0.5 $\mu$m or less, more preferably 0.05 to 0.3 $\mu$m. In addition, an emulsion in which a variation coefficient of grain thickness is 30% or less, i.e., in which the uniformity of thickness is high is also preferable. Furthermore, a grain described in JP-A-63-163451, in which a grain thickness and a distance between twin planes are defined, is preferable.

Dislocations in a tabular grain of the present invention can be controlled by forming a specific iodide rich phase (high iodide phases) inside the grain. More specifically, after substrate grains are prepared, an iodide rich phase is formed by the method of item (1) or (2) below and covered with a phase having an iodide content lower than that of the iodide rich phase.

The iodide content of the substrate tabular grain is lower than that of the iodide rich phase, preferably 0 to 12 mole %, and more preferably 0 to 10 mole %.

The above internal iodide rich phase is a silver halide solid solution containing iodide. This silver halide is preferably silver iodide, silver bromoiodide, or silver bromochloroiodide, more preferably silver iodide or silver bromoiodide (iodide content 10 to 40 mole %), and most preferably silver iodide.

It is most preferred that this internal iodide rich phase is not evenly deposited on the face of a substrate tabular grain but localized. Such localization may occur at any of the major face, the side face, the side, and the corner of a tabular grain. It is also possible to selectively, epitaxially dispose the internal iodide rich phase on these sites.

(1) For this purpose, it is possible to use, for example, a so-called conversion method as described in E. Klein, E. Moisar, G. Murch, *Phot. Korr.,* 102, (4), pages 59 to 63 (1966). An example of this method is a method of adding, during grain formation, halogen ions having a lower solubility for a silver salt than that of halogen ions forming a grain (or a portion close to the surface of a grain) at that time. In the present invention, it is desirable that an addition amount of the halogen ion of a lower solubility be a certain value (associated with a halogen composition) or more with respect to the surface area of grains at that moment. For example, it is preferable to add KI in a certain amount or more with respect to the surface area of AgBr grains at that time during grain formation. More specifically, it is preferable to add $8.2\times10^{-5}$ mole or more of KI per $m^2$ of the surface area (2) It is also possible to use an epitaxial junction method as described in, e.g., JP-A-59-133540, JP-A-58-108526, and JP-A-59-162540. In this method, site directors of epitaxial growth, such as adsorptive spectral sensitizing dyes, can be used.

The "epitaxial growth" means, as is generally recognized in this technical field or in the field of semiconductor crystal growth, that a crystal of one type is grown in accordance with a predetermined orientation relationship on a particular crystal face of a crystal of another type. The internal iodide rich phase can be formed by adding these site directors or by adding a silver salt and a halide solution containing iodide by selecting the conditions (e.g., the pAg, the pH, and the temperature) of grain growth.

In carrying out the above two methods, the solubility of a silver halide of the system is preferably as low as possible. This is so because the solubility of the system has an effect on a distribution on the surface of an iodide rich phase (i.e., a high value of the solubility often leads to homogenization).

In formation of the internal iodide rich phase, the pAg of the mixed system is preferably 6.4 to 10.5, and more preferably 7.1 to 10.2.

The iodide content of the outer phase covering the iodide rich phase is lower than that of the iodide rich phase, preferably 0 to 12 mole %, more preferably 0 to 10 mole %, and most preferably 0 to 3 mole %.

An amount of the internal iodide rich phase with respect to the direction of the major axis of a tabular grain is preferably 5 to 80 mole %, more preferably 10 to 70 mole %, and most preferably 20 to 60 mole %, by a silver amount of the entire grain, from the center of an equivalent-circle diameter.

The direction of the major axis of a grain is the direction of the diameter of a tabular grain, and the direction of the minor axis of a grain is the direction of the thickness of a tabular grain.

The iodide content of the internal iodide rich phase is higher than an average iodide content of silver bromide, silver bromoiodide, or silver bromochloroiodide present on the surface of a grain, preferably 5 times to 50 times, and most preferably 20 times to 50 times the average iodide content.

The silver amount of a silver halide forming the internal iodide rich phase is preferably 50 mole % to 2 mole %, more preferably 10 mole % to 2 mole %, and most preferably 5 mole % to 2 mole % of the silver amount of the entire grain.

Dislocation lines of a tabular grain can be observed by using a transmission electron microscope. It is preferable to select a grain containing several dislocations or a grain containing a large number of dislocations in accordance with the intended use. It is also possible to select dislocations introduced linearly with respect to a specific direction of a crystal orientation of a grain or dislocations curved with respect to that direction. Alternatively, it is possible to introduce dislocations throughout an entire grain or only to a particular portion of a grain, e.g., the fringe portion of a grain.

A silver halide emulsion used in the present invention may be subjected to a treatment for rounding grains, as disclosed in EP 96,727B1 or EP 64,412B1, or surface modification, as disclosed in West German Patent 2,306,447C2 or JP-A-60-221320.

Although a flat grain surface is common, intentionally forming projections and recesses on the surface is preferable in some cases. Examples are a method described in JP-A-58-106532 and JP-A-60-221320, in which a hole is formed in a portion of a crystal, e.g., the corner or the center of the face of a crystal, and a ruffle grain described in U.S. Pat. No. 4,643,966.

The grain size of an emulsion used in the present invention can be evaluated in terms of the equivalent-circle diameter of the projected area of a grain obtained by using an electron microscope, the equivalent-sphere diameter of the volume of a grain calculated from the projected area and the thickness of a grain, or the equivalent-sphere diameter of the volume of a grain obtained by a Coulter counter method. It is possible to selectively use various grains from a very fine grain having an equivalent-sphere diameter of 0.05 $\mu$m or less to a large grain having that of 10 $\mu$m or more. It is preferable to use a grain having an equivalent-sphere diameter of 0.1 to 3 $\mu$m as a light-sensitive silver halide grain.

In the present invention, it is possible to use a so-called polydisperse emulsion having a wide grain size distribution or a monodisperse emulsion having a narrow grain size distribution in accordance with the intended use. As a measure representing the size distribution, a variation coefficient of either the equivalent-projected area diameter of a grain or the equivalent-sphere diameter of the volume of a grain is sometimes used. When a monodisperse emulsion is to be used, it is desirable to use an emulsion having a size distribution with a variation coefficient of preferably 25% or less, more preferably 20% or less, and most preferably 15% or less.

The monodisperse emulsion is sometimes defined as an emulsion having a grain size distribution in which 80% or more of all grains fall within a range of ±30% of an average grain size represented by the number or the weight of grains. In order for a light-sensitive material to satisfy its target gradation, two or more monodisperse silver halide emulsions having different grain sizes can be mixed in a single emulsion layer having essentially the same color sensitivity or can be coated as different layers. It is also possible to mix, or coat as different layers, two or more types of polydisperse silver halide emulsions or monodisperse emulsions together with polydisperse emulsions.

Photographic emulsions used in the present invention can be prepared by the methods described in, e.g., P. Glafkides, Chimie et Physique Photographique, Paul Montel, 1967; G. F. Duffin, Photographic Emulsion Chemistry, Focal Press, 1966; and V. L. Zelikman et al., Making and Coating Photographic Emulsion, Focal Press, 1964. That is, any of an acid method, a neutral method, and an ammonia method can be used. In forming grains by a reaction of a soluble silver salt and a soluble halogen salt, any of a single-jet method, a double-jet method, and a combination of these methods can be used. It is also possible to use a method (so-called reverse double-jet method) of forming grains in the presence of excess silver ions. As one type of the double-jet method, a method in which the pAg of a liquid phase for producing a silver halide is maintained constant, i.e., a so-called controlled double-jet method can be used. This method makes it possible to obtain a silver halide emulsion in which a crystal shape is regular and a grain size is nearly uniform.

By using such a grain as a host grain, essentially silver bromide is epitaxially grown thereon as a guest. In this case, "essentially" means that the epitaxial silver bromide may contain a small amount of silver iodide or silver chloride contained in the host grain. This is so because a portion of a silver halide constituting the host grain generally enters a growth solution during the epitaxial growth and is contained in the epitaxial silver bromide. When x mole % of a silver halide other than silver bromide is contained in the host grain, the effect of the present invention is not degraded if the content of that silver halide in the epitaxial silver bromide is x/3 mole % or less. For example, when a host grain is formed of silver iodobromide containing x mole % of silver iodide, the use of silver iodobromide or silver bromide containing x/3 mole % or less of silver iodide, as a guest, does not degrade the effect of the present invention. JP-A-58-108526 or JP-B-3-45809 describes that silver chloride or silver thiocyanate is preferable for epitaxial deposition because of its high solubility. These silver salts, however, have problems in, e.g., storage stability and repetitive reproducibility. Conventionally, it is difficult to form a well-ordered epitaxial by using silver bromide with a low solubility. However, the formation of a well-ordered epitaxial silver bromide as in the present invention can solve the above problems of storage stability and repetitive reproducibility. Usually, the silver halide consisting essentially of silver bromide is disposed at the corners of the tabular silver halide grain providing the host, by epitaxial growth.

In performing the epitaxial growth, the addition amount of silver nitrate and halogen is preferably 0.001 to 20 mole %, and more preferably 0.01 to 5 mole % with respect to a host grain. During the addition, the pAg is preferably 7 to 12, and more preferably 7 to 10, and the temperature is preferably 40° C. to 70° C. A method of adding spectral sensitizing dyes before the epitaxial growth of silver bromide is preferable in some cases. In these cases, the addition amount of dyes is preferably $4\times10^{-6}$ to $8\times10^{-3}$ mole/mole of Ag, and more preferably $5\times10^{-5}$ to $2\times10^{-3}$ mole/mole of Ag. Silver bromide can be deposited by a regular precipitation process or an Ostwald ripening process.

In formation of silver halide grains of the present invention, at least one of sulfur sensitization, selenium sensitization, gold sensitization, palladium sensitization, noble metal sensitization, and reduction sensitization can be performed at any time during the process of manufacturing a silver halide emulsion. The use of two or more different sensitizing methods is preferable. Several different types of emulsions can be prepared by changing the timing at which the chemical sensitization is performed. The emulsion types are classified into: a type in which a chemical sensitization speck is embedded inside a grain, a type in which it is embedded at a shallow position from the surface of a grain, and a type in which it is formed on the surface of a grain. In emulsions of the present invention, the location of a chemical sensitization speck can be selected in accordance with the intended use.

One chemical sensitization which can be preferably performed in the present invention is chalcogenide sensitization, noble metal sensitization, and a combination of these. The sensitization can be performed by using an active gelation as described in T. H. James, "The Theory of the Photographic Process", 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferable. In the gold sensitization, it is possible to use known sensitizers, such as chloroauric acid, potassium chloroaurate, potassium aurithiocyanate, gold sulfide, and gold selenide. A palladium sensitizer is a salt of divalent or tetravalent palladium. A preferable palladium sensitizer is represented by $R_2PdX_6$ or $R_2PdX_4$ wherein R represents a hydrogen atom, an alkali metal atom, or an ammonium group and X represents a halogen atom, i.e., a chlorine, bromine, or iodine atom. More specifically, the palladium sensitizer is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold sensitizer and the palladium sensitizer be used in combination with a thiocyanate salt or a selenocyanate salt.

Examples of a sulfur sensitizer are hypo, a thiourea-based compound, a rhodanine-based compound, and sulfur-containing compounds described in U.S. Pat. Nos. 3,857,711, 4,266,018, and 4,054,457.

It is preferable to also perform gold sensitization for emulsions of the present invention. An amount of a gold sensitizer is preferably $1\times10^{-4}$ to $1\times10^{-7}$ moles, and more preferably $1\times10^{-5}$ to $5\times10^{-7}$ moles per mole of a silver halide. A preferable amount of a palladium sensitizer is $1\times10^{-3}$ to $5\times10^{-7}$ moles per mole of a silver halide. A preferable amount of a thiocyan compound or a selenocyan compound is $5\times10^{-2}$ to $1\times10^{-6}$ moles per mole of a silver halide.

An amount of a sulfur sensitizer with respect to silver halide grains of the present invention is preferably $1\times10^{-4}$ to $1\times10^{-7}$ moles, and more preferably $1\times10^{-5}$ to $5\times10^{-7}$ moles per mole of a silver halide.

Selenium sensitization is a preferable sensitizing method for emulsions of the present invention. Known unstable selenium compounds are used in the selenium sensitization.

Practical examples of the selenium compound or sensitizer are colloidal metal selenium, selenoureas (e.g., N,N-dimethylselenourea and N,N-diethylselenourea), selenoketones, and selenoamides. In some cases, it is preferable to perform the selenium sensitization in combination with one or both of the sulfur sensitization and the noble metal sensitization. A selenium sensitizer is generally used in an amount of $1\times10^{-4}$ to $1\times10^{-8}$ mole, preferably $1\times10^{-5}$ to $1\times10^{-7}$ mole per mole of silver halide.

The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143.

Silver halide emulsions of the present invention are preferably subjected to reduction sensitization during grain formation, after grain formation and before or during chemical sensitization, or after chemical sensitization.

The reduction sensitization can be selected from a method of adding reduction sensitizers to a silver halide emulsion, a method called silver ripening in which grains are grown or ripened in a low-pAg environment at pAg 1 to 7, and a method called high-pH ripening in which grains are grown or ripened in a high-pH environment at pH 8 to 11. It is also possible to perform two or more of these methods together.

The method of adding reduction sensitizers is preferable in that the level of reduction sensitization can be finely adjusted.

Known examples of the reduction sensitizer are stannous chloride, ascorbic acid and its derivative, amines and polyamines, a hydrazine derivative, formamidinesulfinic acid, a silane compound, and a borane compound. In the reduction sensitization of the present invention, it is possible to use these known reduction sensitizers or to use two or more types of compounds together. Preferable compounds as the reduction sensitizer are stannous chloride, thiourea dioxide, dimethylamineborane, and ascorbic acid and its derivative. Although an addition amount of the reduction sensitizers must be so selected as to meet the emulsion manufacturing conditions, a preferable amount is $10^{-7}$ to $10\times^{-3}$ moles per mole of a silver halide.

The reduction sensitizers are dissolved in water or an organic solvent, such as alcohols, glycols, ketones, esters, or amides, and the resultant solution is added during grain growth. Although adding to a reactor vessel in advance is also preferable, adding at a given timing during grain growth is more preferable. It is also possible to add the reduction sensitizers to an aqueous solution of a water-soluble silver salt or a water-soluble alkali halide to precipitate silver halide grains by using this aqueous solution. Alternatively, a solution of the reduction sensitizers may be added separately several times or continuously over a long time period with grain growth.

It is preferable to use an oxidizer for silver during the process of manufacturing emulsions of the present invention. The oxidizer for silver means a compound having an effect of converting metal silver into silver ions. A particularly effective compound is the one that converts very fine silver grains, as a byproduct in the process of formation of silver halide grains and chemical sensitization, into silver ions. The silver ions thus produced may form a silver salt hardly soluble in water, such as a silver halide, silver sulfide, or silver selenide, or a silver salt readily soluble in water, such as silver nitrate. The oxidizer for silver may be either an inorganic or organic substance. Examples of the inorganic oxidizer are ozone, hydrogen peroxide and its adduct (e.g., $NaBO_2.H_2O_2\cdot3H_2O$, $2NaCO_3\cdot3H_2O_2$, $Na_4P_2O_7.2H_2O_2$, or $2Na_2SO_4.H_2O_2.2H_2O$), a peroxy acid salt (e.g., $K_2S_2O_8$, $K_2C_2O_6$, or $K_2P_2O_8$), a peroxy complex compound (e.g., $K_2[Ti(O_2)C_2O_4].3H_2O$, $4K_2SO_4.Ti(O_2)OH.SO_4.2H_2O$, or $Na_3[VO(O_2)(C_2H_4)_2.6H_2O$), a permanganate (e.g., $KMnO_4$), an oxyacid salt such as chromate (e.g., $K_2Cr_2O_7$), a halogen element such as iodine and bromine, a perhalogenate (e.g., potassium periodate), a salt of a high-valence metal (e.g., potassium hexacyanoferrate (II)), and thiosulfonate.

Examples of the organic oxidizer are quinones such as p-quinone, an organic peroxide such as peracetic acid and perbenzoic acid, and a compound which releases active halogen (e.g., N-bromosuccinimide, chloramine T, and chloramine B).

Preferable oxidizers in the present invention are ozone, hydrogen peroxide and its adduct, a halogen element, an inorganic oxidizer such as a thiosulfonate salt, and an organic oxidizer such as quinones. A combination of the reduction sensitization described above and the oxidizer for silver is preferable. In this case, the reduction sensitization may be performed after the oxidizer is used or vice versa, or the reduction sensitization and the use of the oxidizer may be performed at the same time. These methods can be performed during grain formation or chemical sensitization.

Photographic emulsions used in the present invention may contain various compounds in order to prevent fog during the manufacturing process, storage, or photographic processing of a light-sensitive material, or to stabilize photographic properties. Usable compounds are those known as an antifoggant or a stabilizer, for example, thiazoles, such as benzothiazolium salt, nitroimidazoles, nitrobenzimidazoles, chlorobenzimidazoles, bromobenzimidazoles, mercaptothiazoles, mercaptobenzothiazoles, mecaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; azaindenes, such as triazaindenes, tetrazaindenes (particularly hydroxy-substituted (1,3,3*a*,7)tetrazaindenes), and pentazaindenes. For example, compounds described in U.S. Pat. Nos. 3,954,474 and 3,982,947 and JP-B-52-28660 can be used. One preferable compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and the stabilizers can be added during preparation of an emulsion to achieve their original fog preventing effect and stabilizing effect. In addition, the antifoggants and the stabilizers can be used for various purposes of, e.g., controlling crystal habit of grains, decreasing a grain size, decreasing the solubility of grains, controlling chemical sensitization, and controlling an arrangement of dyes.

Photographic emulsions used in the present invention are preferably subjected to spectral sensitization by methine dyes and the like in order to achieve the effects of the present invention. Usable dyes involve a cyanine dye, a merocyanine dye, a composite cyanine dye, a composite merocyanine dye, a holopolar cyanine dye, a hemicyanine dye, a styryl dye, and a hemioxonole dye. Most useful dyes are those belonging to a cyanine dye, a merocyanine dye, and a composite merocyanine dye. Any nucleus commonly used as a basic heterocyclic nucleus in cyanine dyes can be contained in these dyes. Examples of an applicable nucleus are a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus, and a pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, a benzindolenine nucleus, an indole nucleus, a benzoxazole nucleus, a naphthoxazole nucleus, a benzthiazole nucleus, a naphthothiazole nucleus, a benzoselenazole nucleus, a benzimidazole nucleus, and a quinoline nucleus. These nuclei may have a substituent on a carbon atom.

It is possible for a merocyanine dye or a composite merocyanine dye to have a 5- to 6-membered heterocyclic nucleus as a nucleus having a ketomethylene structure. Examples are a pyrazoline-5-one nucleus, a thiohydantoin nucleus, a 2-thiooxazolidine-2,4-dione nucleus, a thiazolidine-2,4-dione nucleus, a rhodanine nucleus, and a thiobarbituric acid nucleus.

Although these sensitizing dyes may be used singly, they can also be used together. The combination of sensitizing dyes is often used for a supersensitization purpose. Representative examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patents 1,344,281 and 1,507,803, JP-B-43-4936, JP-B-53-12375, JP-A-52-110618, and JP-A-52-109925.

The emulsions used in the present invention may contain, in addition to the sensitizing dyes, dyes having no spectral sensitizing effect or substances not essentially absorbing visible light but presenting supersensitization.

The sensitizing dyes can be added to an emulsion at any point in preparation of an emulsion, which is conventionally known to be useful. Most ordinarily, the addition is performed after completion of chemical sensitization and before coating. However, it is possible to perform the addition at the same time as addition of chemical sensitizing dyes to perform spectral sensitization and chemical sensitization simultaneously, as described in U.S. Pat. Nos. 3,628,969 and 4,225,666. It is also possible to perform the addition prior to chemical sensitization, as described in JP-A-58-113928, or before completion of formation of a silver halide grain precipitation to start spectral sensitization. Alternatively, as disclosed in U.S. Pat. Nos. 4,225,666, these dyes can be added separately; a portion of the dyes may be added prior to chemical sensitization, while the remaining portion is added after that. That is, the dyes can be added at any timing during formation of silver halide grains, including the method disclosed in U.S. Pat. No. 4,183,756.

The addition amount of the spectral sensitizing dye may be $4\times10^{-6}$ to $8\times10^{-3}$ moles per mole of a silver halide. However, for a more preferable silver halide grain size of 0.2 to 1.2 $\mu$m, an addition amount of about $5\times10^{-5}$ to $2\times10^{-3}$ moles per mole of a silver halide is more effective.

The light-sensitive material of the present invention needs only to have at least one of silver halide emulsion layers, i.e., a blue-sensitive layer, a green-sensitive layer, and a red-sensitive layer, formed on a support. The number or order of the silver halide emulsion layers and the non-light-sensitive layers are particularly not limited. A typical example is a silver halide photographic light-sensitive material having, on a support, at least one unit light-sensitive layer constituted by a plurality of silver halide emulsion layers which are sensitive to essentially the same color but have different sensitivities or speeds. The unit light-sensitive layer is sensitive to blue, green or red. In a multi-layered silver halide color photographic light-sensitive material, the unit light-sensitive layers are generally arranged such that red-, green-, and blue-sensitive layers are formed from a support side in the order named. However, this order may be reversed or a layer having a different color sensitivity may be sandwiched between layers having the same color sensitivity in accordance with the application.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-speed emulsion layers can be preferably used as described in West German Patent 1,121,470 or British Patent 923,045. In this case, layers are preferably arranged such that the sensitivity or speed is sequentially decreased toward a support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-speed emulsion layer is formed remotely from a support and a high-speed layer is formed close to the support.

More specifically, layers may be arranged from the farthest side from a support in an order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), an order of BH/BL/GL/GH/ RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-B-56-25738 and JP-B-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an intermediate layer, and a silver halide emulsion layer having sensitivity lower than that of the intermediate layer is arranged as a lower layer. In other words, three layers having different sensitivities may be arranged such that the sensitivity is sequentially decreased toward the support. When a layer structure is constituted by three layers having different sensitivities or speeds, these layers may be arranged in an order of medium-speed emulsion layer/high-speed emulsion layer/low-speed emulsion layer from the farthest side from a support in a layer having the same color sensitivity as described in JP-A-59-202464.

Also, an order of high-speed emulsion layer/low-speed emulsion layer/medium-speed emulsion layer, or low-speed emulsion layer/medium-speed emulsion layer/high-speed emulsion layer may be adopted. Furthermore, the arrangement can be changed as described above even when four or more layers are formed.

As described above, various layer configurations and arrangements can be selected in accordance with the application of the light-sensitive material.

Although various additives as described above can be used in the light-sensitize material, the other additives may be used in accordance with the intended application.

These additives are described in detail in RD Item 17643 (December 1978), RD Item 18716 (November 1979) and RD Item 307105 (November 1989), and they are summarized in Table A below:

TABLE A

| Additives | RD17643 | RD18716 | RD307105 |
|---|---|---|---|
| 1. Chemical sensitizers | page 23 | page 648, right column | page 866 |
| 2. Sensitivity-increasing agents | | page 648, right column | |
| 3. Spectral sensitizers, super-sensitizers | pp. 23–24 | page 648, right column to page 649, right column | pp. 866–868 |
| 4. Brighteners | page 24 | page 648, right column | pp. 868 |
| 5. Antifoggants, stabilizers | pp. 24–25 | page 649, right | pp. 868–870 |
| 6. Light absorbent, filter dye, ultraviolet absorbents | pp. 25–26 | page 649, right column to page 650, left column | page 873 |
| 7. Stain-preventing agents | page 25, right column | page 650, left-right columns | page 872 |
| 8. Dye image-stabilizer | page 25 | page 650, left column | page 872 |
| 9. Hardening agents | page 26 | page 651, left column | pp. 874–875 |
| 10. Binder | page 26 | page 651, left column | pp. 873–874 |
| 11. Plasticizers, lubricants | page 27 | page 650, right column | page 876 |
| 12. coating aids, surface active agents | pp. 26–27 | page 650, right column | pp. 875–876 |
| 13. Antistatic agents | page 27 | page 650, right column | pp. 876–877 |

In order to prevent degradation in photographic properties caused by formaldehyde gas, a compound described in U.S. Pat. Nos. 4,411,987 or 4,435,503, which can react with formaldehyde and fix the same, is preferably added to the light-sensitive material.

Various color couplers can be used in the present invention, and specific examples of these couplers are described in patents described in the above-mentioned RD No. 17643, VII-C to VII-G and RD No. 307105, VII-C to VII-G.

Preferable examples of yellow couplers are described in, e.g., U.S. Pat. Nos. 3,933,501; 4,022,620; 4,326,024; 4,401,752 and 4,248,961, JP-B-58-10739, British Patents 1,425,020 and 1,476,760, U.S. Pat. Nos. 3,973,968; 4,314,023 and 4,511,649, and European Patent 249,473A.

Examples of a magenta coupler are preferably 5-pyrazolone type and pyrazoloazole type compounds, and more preferably, compounds described in, for example, U.S. Pat. Nos. 4,310,619 and 4,351,897, European Patent 73,636, U.S. Pat. Nos. 3,061,432 and 3,725,067, RD No. 24220 (June 1984), JP-A-60-33552, RD No. 24230 (June 1984), JP-A-60-43659, JP-A-61-72238, JP-A-60-35730, JP-A-55-118034, JP-A-60-185951, U.S. Pat. Nos. 4,500,630; 4,540,654 and 4,556,630, and WO No. 88/04795.

Examples of a cyan coupler are phenol type and naphthol type ones. Of these, preferable are those described in, for example, U.S. Pat. Nos. 4,052,212; 4,146,396; 4,228,233; 4,296,200; 2,369,929; 2,801,171; 2,772,162; 2,895,826; 3,772,002; 3,758,308; 4,343,011 and 4,327,173, West German Patent Laid-open Application 3,329,729, European Patents 121,365A and 249,453A, U.S. Pat. Nos. 3,446,622; 4,333,999; 4,775,616; 4,451,559; 4,427,767; 4,690,889; 4,254,212 and 4,296,199, and JP-A-61-42658. Also, the pyrazoloazole type couplers disclosed in JP-A-64-553, JP-A-64-554, JP-A-64-555 and JP-A-64-556, and imidazole type couplers disclosed in U.S. Pat. No. 4,818,672 can be used as cyan coupler in the present invention.

Typical examples of a polymerized dye-forming coupler are described in, e.g., U.S. Pat. Nos. 3,451,820; 4,080,211; 4,367,282; 4,409,320 and 4,576,910, British Patent 2,102,173, and European Patent 341,188A.

Preferable examples of a coupler capable of forming colored dyes having proper diffusibility are those described in U.S. Pat. No. 4,366,237, British Patent 2,125,570, European Patent 96,570, and West German Laid-open Patent Application No. 3,234,533.

Preferable examples of a colored coupler for correcting unnecessary absorption of a colored dye are those described in RD No. 17643, VII-G, RD No. 30715, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Those compounds which release a photographically useful residue upon coupling are preferably used in the present invention. DIR couplers, i.e., couplers releasing a development inhibitor are described in the patents cited in the above-described RD No. 17643, VII-F and RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

Preferable examples of a coupler which imagewise releases a nucleating agent or a development accelerator are described in British Patents 2,097,140 and 2,131,188, JP-A-59-157638, and JP-A-59-170840. In addition, compounds releasing, e.g., a fogging agent, a development accelerator, or a silver halide solvent upon redox reaction with an oxidized form of a developing agent, described in JP-A-60-107029, JP-A-60-252340, JP-A-1-44940, and JP-A-1-45687, can also be used.

Examples of other compounds which can be used in the light-sensitive material of the present invention are competing couplers described in, for example, U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, for example, JP-A-60-185950 and JP-A-62-24252; couplers releasing a dye which restores color after being released described in European Patent 173,302A and 313,308A; a ligand releasing coupler described in, e.g., U.S. Pat. No. 4,553,477; a coupler releasing a leuco dye described in JP-A-63-75747; and a coupler releasing a fluorescent dye described in U.S. Pat. No. 4,774,181.

The couplers for use in this invention can be introduced into the light-sensitive material by various known dispersion methods.

Examples of a high-boiling point organic solvent to be used in the oil-in-water dispersion method are described in, e.g., U.S. Pat. No. 2,322,027. Examples of a high-boiling point organic solvent to be used in the oil-in-water dispersion method and having a boiling point of 175° C. or more at atmospheric pressure are phthalic esters (e.g., dibutylphthalate, dicyclohexylphthalate, di-2-ethylhexylphthalate, decylphthalate, bis(2,4-di-t-amylphenyl) phthalate, bis(2,4-di-t-amylphenyl) isophthalate, bis(1,1-di-ethylpropyl) phthalate), phosphate or phosphonate esters (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoate esters (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearyl alcohol and 2,4-di-tert-amylphenol), aliphatic carboxylate esters (e.g., bis(2-ethylhexyl) sebacate, dioctylazelate, glyceroltributyrate, isostearyllactate, and trioctylcitrate), an aniline derivative (e.g., N,N-dibutyl-2-butoxy-5-tert-octylaniline), and hydrocarbons (e.g., paraffin, dodecylbenzene, and diisopropylnaphthalene). An organic solvent having a boiling point of about 30° C. or more, and preferably, 50° C. to about 160° C. can be used as an auxiliary solvent. Typical examples of the auxiliary solvent are ethyl acetate, butyl acetate, ethyl propionate, methylethylketone, cyclohexanone, 2-ethoxyethylacetate, and dimethylformamide.

Steps and effects of a latex dispersion method and examples of an immersing latex are described in, e.g., U.S. Pat. No. 4,199,363 and German Laid-open Patent Application (OLS) Nos. 2,541,274 and 2,541,230.

Various types of antiseptics and fungicides agent are preferably added to the color light-sensitive material of the present invention. Examples of the antiseptics and the fungicides are phenethyl alcohol, and 1,2-benzisothiazolin-3-one, n-butyl p-hydroxybenzoate, phenol, 4-chloro-3,5-dimethylphenol, 2-phenoxyethanol, and 2-(4-thiazolyl) benzimidazole, which are described in JP-A-63-257747, JP-A-62-272248, and JP-A-1-80941.

The present invention can be applied to various color light-sensitive materials. Examples of the material are a color negative film for a general purpose or a movie, a color reversal film for a slide or a television, a color paper, a color positive film, and a color reversal paper.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the sum total of film thicknesses of all hydrophilic colloidal layers at the side having emulsion layers is preferably 28 μm or less, more preferably, 23 μm or less, much more preferably, 18 μm or less, and most preferably, 16 μm or less. A film swell speed $T_{1/2}$ is preferably 30 seconds or less, and more preferably, 20 seconds or less. The film thickness means a film thickness measured under moisture conditioning at a temperature of 25° C. and a relative humidity of 55% (two days). The film swell speed $T_{1/2}$ can be measured in accordance with a known method in the art. For example, the film swell speed $T_{1/2}$ can be measured by using a swellometer described by A. Green et al. in Photographic Science & Engineering, Vol. 19, No. 2, pp. 124 to 129. When 90% of a maximum swell film thickness reached by performing a treatment by using a color developing agent at 30° C. for 3 minutes and 15 seconds is defined as a saturated film thickness, $T_{1/2}$ is defined as a time required for reaching ½ of the saturated film thickness.

The film swell speed $T_{1/2}$ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation:

(maximum swell film thickness-film thickness)/film thickness.

In the light-sensitive material of the present invention, a hydrophilic colloid layer (called back layer) having a total dried film thickness of 2 to 20 μm is preferably formed on the side opposite to the side having emulsion layers. The back layer preferably contains, e.g., the light absorbent, the filter dye, the ultraviolet absorbent, the antistatic agent, the film hardener, the binder, the plasticizer, the lubricant, the coating aid, and the surfactant, described above. The swell ratio of the back layer is preferably 150% to 500%.

The color photographic light-sensitive material according to the present invention can be developed by conventional methods described in RD. No. 17643, pp. 28 and 29, RD. No. 18716, the left to right columns, page 651, and RD. No. 307105, pp. 880 and 881.

A color developer used in development of the light-sensitive material of the present invention is an aqueous alkaline solution containing as a main component, preferably, an aromatic primary amine color developing agent. As the color developing agent, although an aminophenol compound is effective, a p-phenylenediamine compound is preferably used. Typical examples of the p-phenylenediamine compound are: 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and the sulfates, hydrochlorides and p-toluenesulfonates thereof. Of these, 3-methyl-4-amino-N-ethyl-N-(β-hydroxyethyl)aniline sulfate is most preferred. The above compounds can be used in a combination of two or more thereof in accordance with the application.

In general, the color developer contains a pH buffering agent such as a carbonate, a borate or a phosphate of an alkali metal, and a development restrainer or an antifoggant such as a chloride, a bromide, an iodide, a benzimidazole, a benzothiazole, or a mercapto compound. If necessary, the color developer may also contain a preservative such as hydroxylamine, diethylhydroxylamine, a sulfite, a hydrazine such as N,N-biscarboxymethylhydrazine, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye-forming coupler; a competing coupler; an auxiliary developing agent such as 1-phenyl-3-pyrazolidone; a viscosity-imparting agent; and a chelating agent such as an aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof.

In order to perform reversal development, black-and-white development is performed and then color development is performed. As a black-and-white developer, a well-known black-and-white developing agent, e.g., a dihydroxybenzene such as hydroquinone, a 3-pyrazolidone such as 1-phenyl-3-pyrazolidone, and an aminophenol such as N-methyl-p-aminophenol can be used singly or in a combination of two or more thereof.

The pH of the color and black-and-white developers is generally 9 to 12. Although the quantity of replenisher of the developers depends on a color photographic light-sensitive material to be processed, it is generally 3 liters or less per $m^2$ of the light-sensitive material. The quantity of replenisher can be decreased to be 500 ml or less by decreasing a bromide ion concentration in a replenisher. When the quantity of the replenisher is decreased, a contact area of a processing tank with air is preferably decreased to prevent evaporation and oxidation of the solution upon contact with air.

The contact area of the processing solution with air in a processing tank can be represented by an aperture defined below:

Aperture=[contact area ($cm^2$) of processing solution with air]/[volume ($cm^3$) of the solution]

The above aperture is preferably 0.1 or less, and more preferably, 0.001 to 0.05. In order to reduce the aperture, a shielding member such as a floating cover may be provided on the surface of the photographic processing solution in the processing tank. In addition, a method of using a movable cover described in JP-A-1-82033 or a slit developing method described in JP-A-63-216050 may be used. The aperture is preferably reduced not only in color and black-and-white development steps but also in all subsequent steps, e.g., bleaching, bleach-fixing, fixing, washing, and stabilizing steps. In addition, the quantity of replenisher can be reduced by using a means of suppressing storage of bromide ions in the developing solution.

A color development time is normally 2 to 5 minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the application. Examples of the bleaching agent are compounds of a polyvalent metal, e.g., iron (III); peracids; quinones; and nitro compounds. Typical examples of the bleaching agent are an organic complex salt of iron (III), e.g., a complex salt with an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid; or a complex salt with citric acid, tartaric acid, or malic acid. Of these compounds, an iron (III) complex salt of an aminopolycarboxylic acid such as an iron (III) complex salt of ethylenediaminetetraacetic acid or 1,3-diaminopropanetetraacetic acid is preferred because it can increase a processing speed and prevent an environmental contamination. The iron (III) complex salt of an aminopolycarboxylic acid is useful in both the bleaching and bleach-fixing solutions. The pH of the bleaching or bleach-fixing solution using the iron (III) complex salt of an aminopolycarboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Examples of a useful bleaching accelerator are: compounds having a mercapto group or a disulfide group described in, for example, U.S. Pat. Nos. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and Research Disclosure No. 17129 (July, 1978); thiazolidine derivatives described in JP-A-50-140129; thiourea derivatives described in JP-B-45-8506, JP-A-52-20832, JP-A-53-32735, and U.S. Pat. No. 3,706,561; iodide salts described in West German Patent 1,127,715 and JP-A-58-16235; polyoxyethylene compounds described in West German Patents 966,410 and 2,748,430; polyamine compounds described in JP-B-45-8836; compounds described in JP-A-49-40943, JP-A-49-59644, JP-A-53-94927, JP-A-54-35727, JP-A-55-26506, and JP-A-58-163940; and a bromide ion.

Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, preferably acetic acid, or propionic acid.

Examples of the fixing agent used in the fixing solution or the bleach-fixing solution are a thiosulfate salt, a thiocyanate salt, a thioether-based compound, a thiourea and a large amount of an iodide. Of these compounds, a thiosulfate, especially, ammonium thiosulfate can be used in the widest range of applications. In addition, a combination of a thiosulfate with a thiocyanate, a thioether-based compound, or thiourea is preferably used. As a preservative of the fixing solution or the bleach-fixing solution, a sulfite, a bisulfite, a carbonyl bisulfite adduct, or a sulfinic acid compound described in European Patent 294,769A is preferred. In addition, in order to stabilize the fixing solution or the bleach-fixing solution, various types of aminopolycarboxylic acids or organic phosphonic acids are preferably added to the solution.

In the present invention, 0.1 to 10 mol/liter of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of a desilvering step is preferably as short as possible as long as no desilvering defect occurs. A preferable time is one to three minutes, and more preferably, one to two minutes. A processing temperature is 25° C. to 50° C., and preferably, 35° C. to 45° C. Within the preferable temperature range, a desilvering speed is increased, and generation of a stain after the processing can be effectively prevented.

In the desilvering step, stirring is preferably as strong as possible. Examples of a method of intensifying the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyer means described in JP-A-60-191257, JP-A-60-191258, or JP-A-60-191259. As described in JP-A-60-191257, this conveyer means can significantly reduce carry-over of a processing solution from a pre-bath to a post-bath, thereby effectively preventing degradation in performance of the processing solution. This effect significantly shortens especially a processing time in each processing step and reduces the quantity of replenisher of a processing solution.

The photographic light-sensitive material of the present invention is normally subjected to washing and/or stabilizing steps after desilvering. An amount of water used in the washing step can be arbitrarily determined over a broad range in accordance with the properties (e.g., a property determined by the substances used, such as a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineering", Vol. 64, PP. 248–253 (May, 1955).

In the multi-stage counter-current scheme disclosed in this reference, the amount of water used for washing can be greatly decreased. Since washing water stays in the tanks for a long period of time, however, bacteria multiply and floating substances may be adversely attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and a cyabendazole described in JP-A-57-8542, a chlorine-based germicide such as chlorinated sodium isocyanurate, and germicides such as benzotriazole, described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bobai Gakkai ed., "Dictionary of Antibacterial and Antifungal Agents", (1986), can be used.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of water-washing. All known methods described in JP-A-57-8543, JP-A-58-14834, and JP-A-60-220345 can be used in such stabilizing processing.

In some cases, stabilizing is performed subsequently to washing. An example is a stabilizing bath containing a dye stabilizing agent and a surface-active agent to be used as a final bath of the photographic color light-sensitive material. Examples of the dye stabilizing agent are an aldehyde such as formalin or glutaraldehyde, an N-methylol compound, hexamethylenetetramine, and an adduct of aldehyde sulfite. Various chelating agents and fungicides can be added to the stabilizing bath.

An overflow solution produced upon washing and/or replenishment of the stabilizing solution can be reused in another step such as a desilvering step.

In the processing using an automatic developing machine or the like, if each processing solution described above is condensed by evaporation, water is preferably added to correct a concentration.

The silver halide color light-sensitive material of the present invention may contain a color developing agent in order to simplify processing and increases a processing speed. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599 and RD Nos. 14850 and 15159, an aldol compound described in RD No. 13924, a metal salt complex described in U.S. Pat. No. 3,719,492, and a urethane-based compound described in JP-A-53-135628.

The silver halide color light-sensitive material of the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

The silver halide light-sensitive material of the present invention can also be applied to a heat-developing light-sensitive material disclosed in, e.g., U.S. Pat. No. 4,500,626, JP-A-60-133449, JP-A-59-218443, JP-A-61-238056, and European Patent 210,660A2.

The present invention will be described in more detail below by way of its examples.

EXAMPLE 1

(1) Preparation of Emulsions

A. Preparation of Substrate Emulsion

Preparation of emulsion A (Ag ratio of central region/central annular region/peripheral region 16.7/67.3/16; silver iodide content ratio of the three regions 0/4.6/12)

While 1.0 l of an aqueous deionized gelatin 0.7% solution (solution A) containing 0.57 mole of potassium bromide was stirred at 30° C., an aqueous solution of 1.95 moles of potassium bromide (solution B) and an aqueous solution of 1.9 moles of silver nitrate (solution C) were added to the solution A by a double-jet method at the same constant flow rate over 30 seconds (2.06% of the total silver nitrate amount were consumed). After 400 ml of an 8% deionized gelation solution were added, the temperature was increased to 75° C. An aqueous solution of 1.12 moles of silver nitrate (solution D) was added to adjust the pBr to 2.13 (1.84% of the total silver nitrate amount were consumed), and an aqueous 14.7N ammonia solution was added to adjust the pH to 8.3, and physical ripening was performed. Thereafter, 1N nitric acid was added to again adjust the pH to 5.5. An aqueous solution of 1.34 moles of potassium bromide (solution E) and the solution D were simultaneously added while accelerating the flow rate (such that the final flow rate was 2.5 times that at the beginning) over 11 minutes with the pBr maintained at 1.56 (12.8% of the total silver nitrate amount were consumed). Thereafter, 1N NaOH was added to control the pH to 9.3. An aqueous solution (solution F) containing 1.35 moles of potassium bromide and 0.065 mole of potassium iodide and the solution D were simultaneously added while accelerating the flow rate (such that the final flow rate was 5.5 times that at the beginning) over 28.5 minutes with the pBr maintained at 1.56 (67.3% of the total silver nitrate amount were consumed). In addition, the solution D and an aqueous solution (solution G) containing 1.24 moles of potassium bromide and 0.17 mole of potassium iodide were simultaneously added while accelerating the flow rate (such that the final flow rate was twice that at the beginning) over 10 minutes with the pBr maintained at 2.42 (16% of the total silver nitrate amount were consumed). Subsequently, desalting was performed by a regular flocculation process to prepare a tabular AgBrI (AgI=5.0 moles) emulsion A with an average aspect ratio of 6.5 and an equivalent-circle diameter of 1.0 $\mu$m. The amount of silver nitrate used was 156 g. The resultant high-aspect-ratio tabular silver bromoiodide grain was found to have a surface silver iodide concentration of 10.8 mole % and an average silver iodide concentration of 4.9 mole %, indicating that the silver iodide concentration in the peripheral region was higher than that in the central region.

B. Preparation of grains having dislocations (B-1) 500 g of the substrate emulsion A (0.5 mole Ag) and 350 cc of distilled water were mixed, and the resultant mixture was heated up to 40° C. and stirred sufficiently. While this condition was maintained, the following procedures were performed.

(B-2) A potassium iodide solution (concentration 0.04 mole/l) was added in an amount corresponding to 1.2 mole % with respect to a silver amount of the substrate emulsion over 15 minutes.

(B-3) A potassium iodide solution (concentration 0.04 mole/l) was added in an amount corresponding to 1.3 mole % with respect to a silver amount of the substrate emulsion over 8 minutes.

(B-4) A silver nitrate solution (concentration 1.02 mole/l) and a potassium bromide solution (concentration 1.02 mole/l) were added in an amount corresponding to 50 mole % with respect to a silver amount of the substrate emulsion over 49 minutes while the pBr was kept at 1.73.

(B-5) Desalting was performed by a flocculation process.

An emulsion (emulsion B) prepared by the above method using the emulsion A as the substrate emulsion was found to have an average aspect ratio of 6.5 and an equivalent-circle diameter of 1.3 $\mu$m.

C. Preparation of grains having no dislocations

Of the procedures (B-1) to (B-5) described in B, only (B-1), (B-4), and (B-5) were performed. The emulsion thus prepared was labeled an "emulsion C".

(2) Spectral Sensitization $6.5\times10^{-4}$ mole, per mole of Ag, of a sensitizing dye represented by a formula below were added to the emulsions B and C to prepare emulsions D and E, respectively.

Sensitizing dye

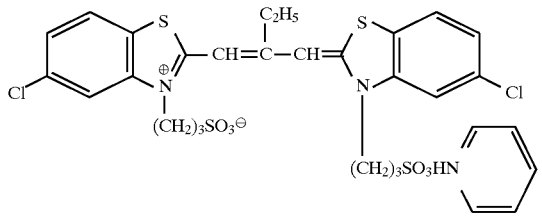

(3) Formation of grains having epitaxial growth layer at corners 0.04 moleAg/moleAg of fine silver bromide grains (cubic grains with an equivalent-sphere diameter of 0.05 $\mu$m) was added to the emulsions D and E subjected to spectral sensitization, and the resultant emulsions were kept at 60° C. for 30 minutes. The emulsion prepared from the emulsion D was labeled an "emulsion F", and that from the emulsion E was labeled an "emulsion G". FIG. 1 is a photograph showing a typical grain structure obtained by observing the emulsion F by using an electron microscope (magnification ×30,000). As can be clearly seen from FIG. 1, epitaxial growth layer was present at the corners of grains.

(4) Chemical Sensitization $Na_2S_2O_3$, KSCN, and $HAuCl_4$ were added to the emulsions D, E, F, and G such that the highest sensitivities were obtained when exposure was performed for 1/100 second, and the resultant emulsions were held at 60° C. for 60 minutes.

(5) Making and Evaluation of Coated Samples

The emulsions D, E, F, and G were coated in amounts as shown in Table B below on cellulose triacetate film supports having subbing layers to form emulsion and protective layers, thereby making coated samples.

TABLE B

| Emulsion coating conditions | |
|---|---|
| (1) Emulsion layer | |
| Each Emulsion. | (silver $3.6\times10^{-2}$ mole/m$^2$) |
| Coupler represented by formula below | ($1.5\times10^{-3}$ mole/m$^2$) |

TABLE B-continued

Emulsion coating conditions

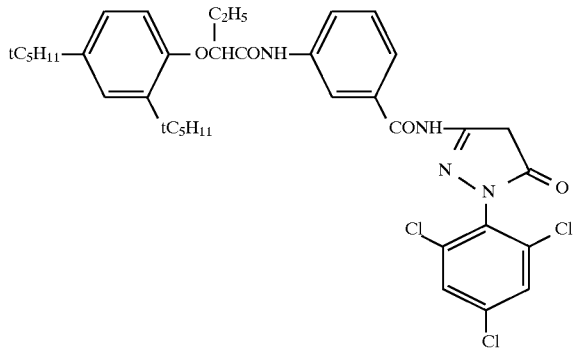

| | |
|---|---|
| Tricresylphosphate | (1.10 g/m$^2$) |
| Gelatin | (2.30 g/m$^2$) |
| (2) Protective layer | |
| 2,4-dichloro-6-hydroxy-s-triazine sodium salt | (0.08 g/m$^2$) |
| Gelatin | (1.80 g/m$^2$) |

These samples were left to stand at a temperature of 40° C. and a relative humidity of 70% for 14 hours, exposed through a continuous wedge for 1/100 second, and subjected to color development shown in Table C below.

The densities of the samples thus processed were measured through a green filter.

TABLE C

| Process | Time | Temperature |
|---|---|---|
| Color development | 2 min. 00 sec. | 40° C. |
| Bleach-fixing | 3 min. 00 sec. | 40° C. |
| Washing (1) | 20 sec. | 35° C. |
| Washing (2) | 20 sec. | 35° C. |
| Stabilization | 20 sec. | 35° C. |
| Drying | 50 sec. | 65° C. |

The compositions of the individual processing solutions are given below.

| | (g) |
|---|---|
| (Color developing solution) | |
| Diethylenetriaminepentaacetic acid | 2.0 |
| 1-hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-[N-ethyl-N-β-hydroxylethylamino]-2-methylaniline sulfate | 4.5 |
| Water to make | 1.0 l |
| pH | 10.05 |
| (Bleach-fixing solution) | |
| Ferric ammonium ethylenediamine-tetraacetate dihydrate | 90.0 |
| Disodium ethylenediaminetetraacetate | 5.0 |
| Sodium sulfite | 12.0 |
| Ammonium thiosulfate aqueous solution (70%) | 260.0 ml |
| Acetic acid (98%) | 5.0 ml |

-continued

| | (g) |
|---|---|
| Bleaching accelerator represented by formula below | 0.01 mole |
| Water to make | 1.0 l |
| pH | 6.0 |

Bleaching accelerator

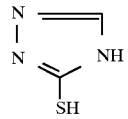

(Washing solution)

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/l or less. Subsequently, 20 mg/l of sodium isocyanuric acid dichloride and 0.15 g/l of sodium sulfate were added.

The pH of the solution fell within the range of 6.5 to 7.5.

| (Stabilizing solution) | (g) |
|---|---|
| Formalin (37%) | 2.0 ml |
| Polyoxyethylene-p-monononylphenylether (average polymerization degree = 10) | 0.3 |
| Disodium ethylenediaminetetraacetate | 0.05 |
| Water to make | 1.0 l |
| pH | 5.0–8.0 |

The relative sensitivity and fog obtained by the above color development were evaluated. The results are summarized in Table 1 below. Note that the sensitivity is represented by a relative value of the logarithm of the reciprocal of an exposure amount (lux.sec) at which a density of fog+0.2 is given (assuming that the sensitivity obtained one day after the emulsion E was coated is 100).

TABLE 1

| Emulsion name | Dislocations | Epitaxial silver bromide | Relative sensitivity | Fog | Remarks |
|---|---|---|---|---|---|
| D | Present | Absent | 115 | 0.17 | Comparative example |
| E | Absent | Absent | 100 | 0.08 | Comparative example |
| F | Present | Present | 126 | 0.10 | Present invention |
| G | Absent | Present | 105 | 0.08 | Comparative example |

As can be seen by comparing the emulsions E and G shown in Table 1, in grains having no dislocations, no change was found in fog and an increase in sensitivity was small even after epitaxial growth. In grains having dislocations, however, the existence of the epitaxial layer suppressed fog and greatly increased the sensitivity although the sensitivity was originally very high. That is, the effect of the epitaxial layer was achieved more effectively in grains having dislocations.

EXAMPLE 2

(1) Preparation of Emulsions

The procedures (3) and (4) in Example 1 were performed in the reverse order for the emulsions D and E of Example 1 to prepare emulsions H and I, respectively.

(2) Making and Evaluation of Coated Samples

The emulsions H and E were evaluated following the same procedures as in (5) of Example 1. The results are summarized in Table 2 below. Note that Table 2 also shows the evaluation results of the emulsions D and E.

TABLE 2

| Emulsion name | Dislocations | Epitaxial silver bromide | Relative sensitivity | Fog | Remarks |
|---|---|---|---|---|---|
| D | Present | Absent | 115 | 0.17 | Comparative example |
| E | Absent | Absent | 100 | 0.08 | Comparative example |
| H | Present | Present | 122 | 0.10 | Present invention |
| I | Absent | Present | 103 | 0.06 | Comparative example |

As can be seen from Table 2, the effect of the epitaxial layer was significant in grains having dislocations; grains with a high sensitivity and a low fog could be obtained.

EXAMPLE 3

Layers having the compositions presented below were coated on subbed cellulose triacetate film supports to make samples 301 to 304 containing the emulsions D, E, F, and G, respectively, in the fifth layer (red-sensitive emulsion layer) of a multilayered color light-sensitive material.

(Compositions of light-sensitive layers)

The coating amount of each of a silver halide and colloidal silver is represented by the silver amount in units of $g/m^2$. The coating amount of each of a coupler, an additive, and gelatin is represented by an amount in units of $g/m^2$. The coating amount of a sensitizing dye is represented in units of moles per mole of a silver halide in the same layer. Note that symbols representing additives have the following meanings. Note also that an additive having a plurality of effects is represented by only one of the effects.

UV; ultraviolet absorbent, HBS; high-boiling point organic solvent, ExS; sensitizing dye, ExC; cyan coupler, ExM; magenta coupler, ExY; yellow coupler, Cpd; additive, W; surfactant, H; hardener, F; stabilizer.

The added compounds are enumerated below.

ExC-1

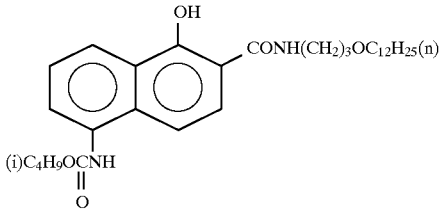

ExC-2

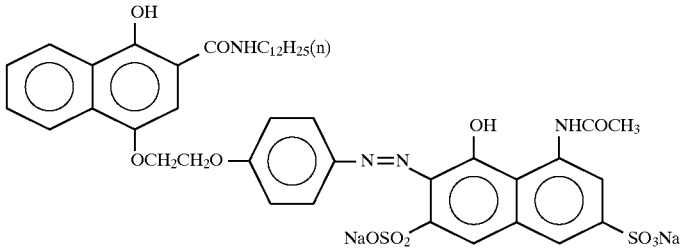

ExC-3

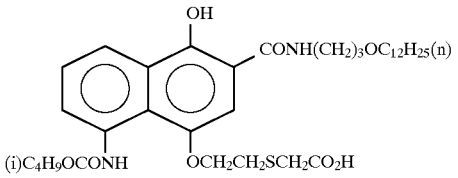

ExC-4

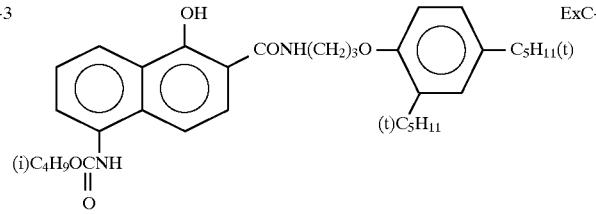

-continued
ExC-5
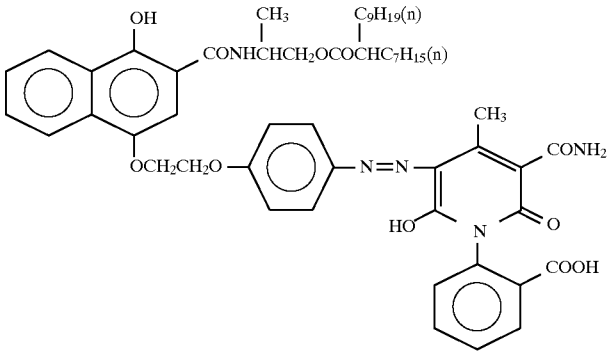
ExC-6
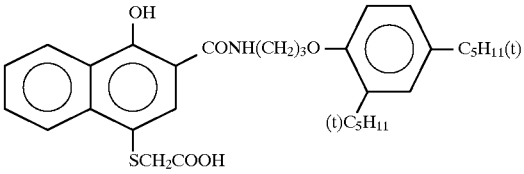
ExC-7
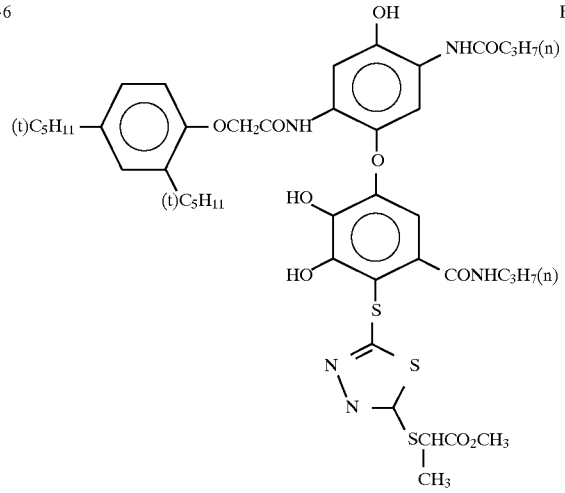
ExM-1
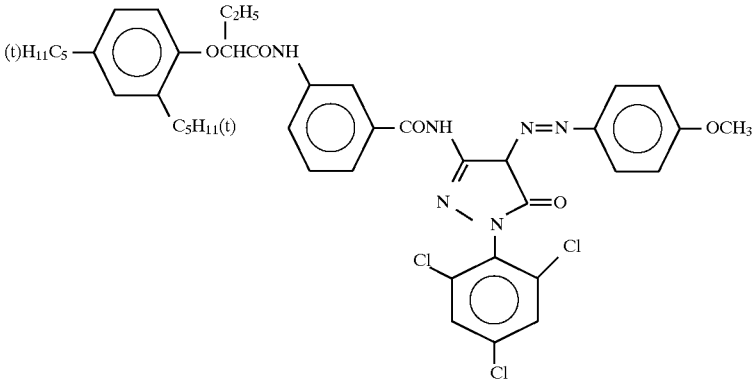
ExM-2
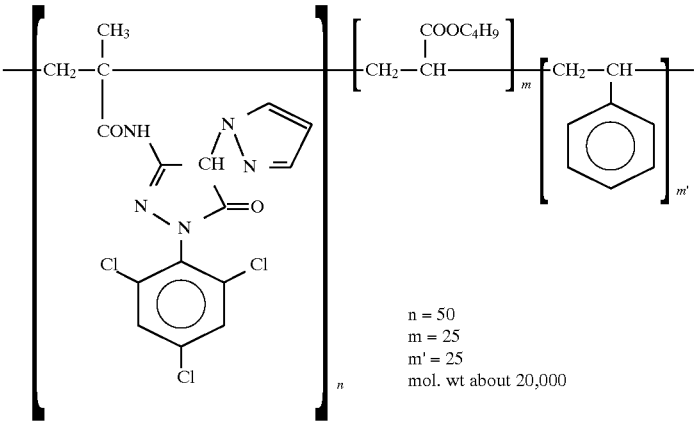
n = 50
m = 25
m' = 25
mol. wt about 20,000

-continued
ExM-3
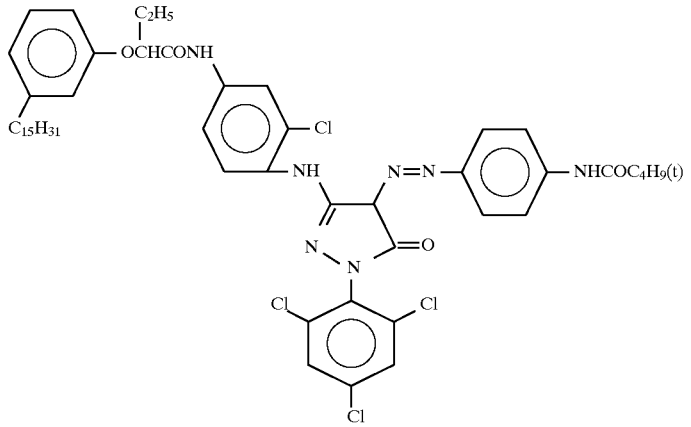
ExM-4
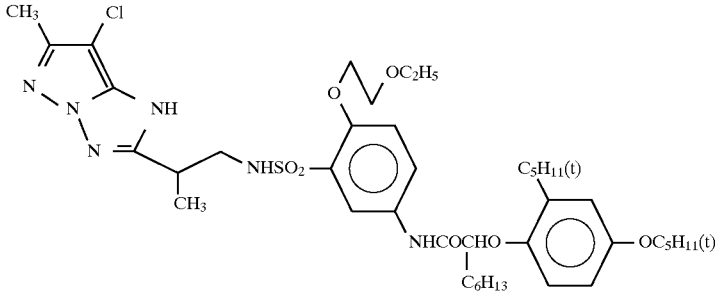
ExM-5
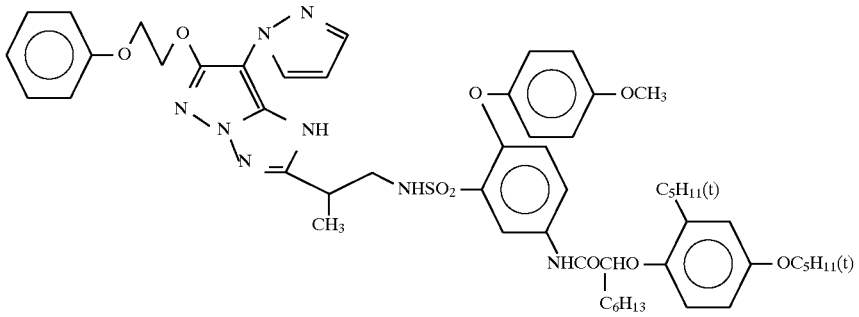
ExY-1
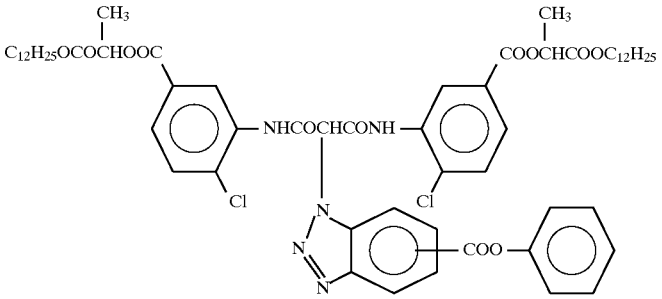
ExY-2
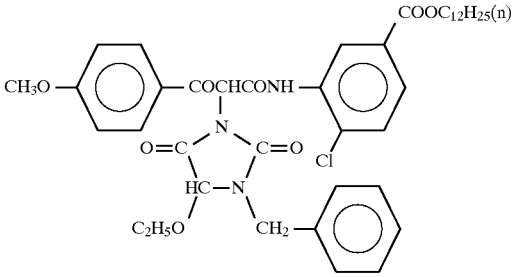
ExF-1
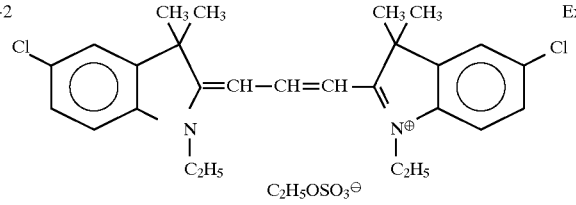

-continued
Cpd-1
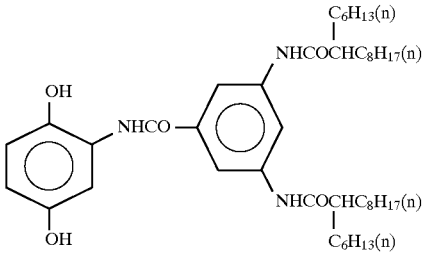
UV-1
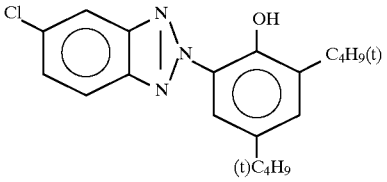
UV-2
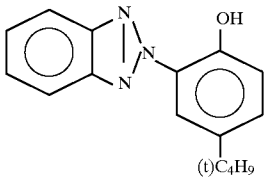
UV-3
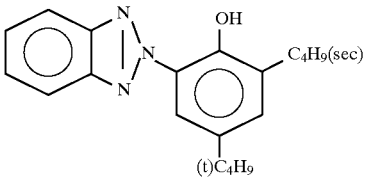
UV-4
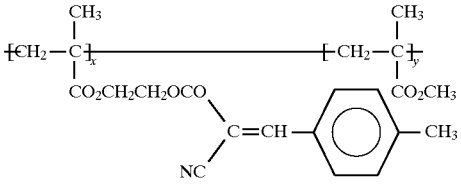
x:y = 70:30 (wt %)
UV-5
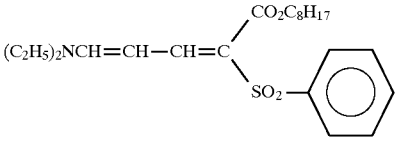
Tricresylphosphate HBS-1
Di-n-butylphthalate HBS-2
HBS-3
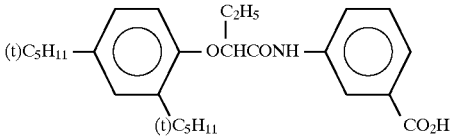
ExS-1
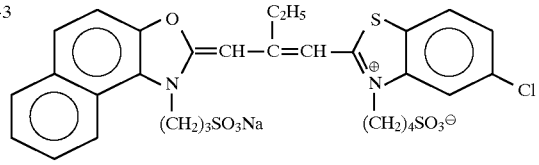
ExS-2
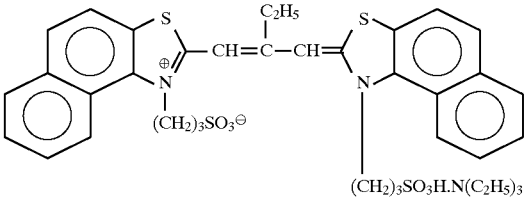
ExS-3
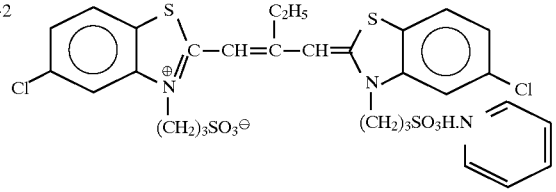
ExS-4
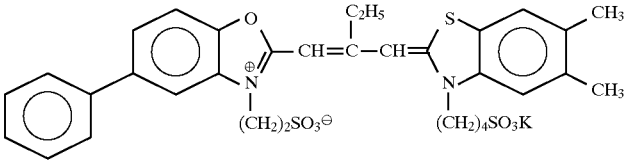
ExS-5
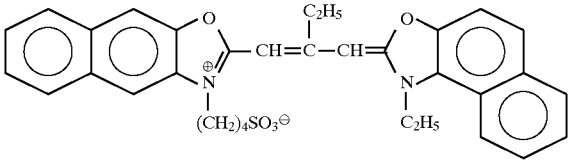
ExS-6
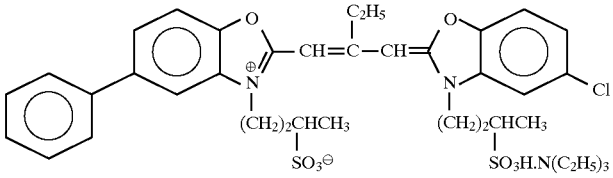

-continued
ExS-7
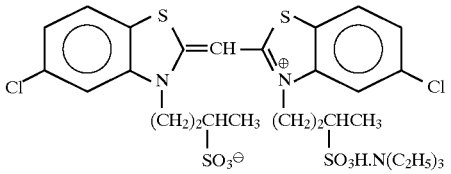
S-1
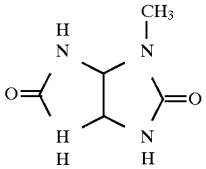
H-1
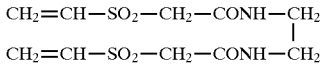
B-1
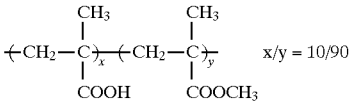
x/y = 10/90
B-2
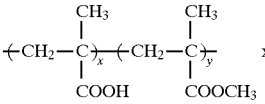
x/y = 40/60
B-3
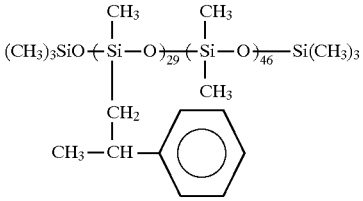
B-4
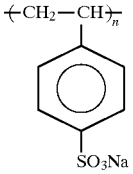
B-5
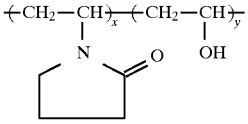
x/y = 70/30
B-6
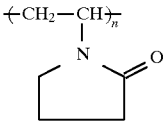
(mol. wt. about 10,000)
W-1
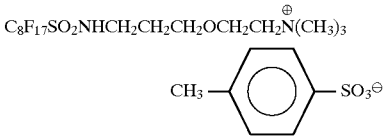
W-2
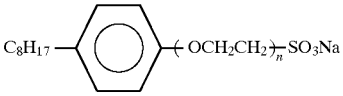
n = 2 to 4
W-3
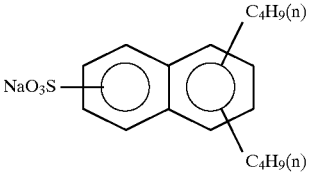
F-1
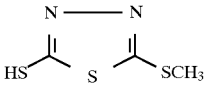
F-2
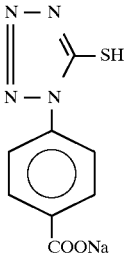
F-3
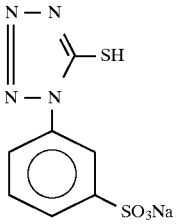
F-4
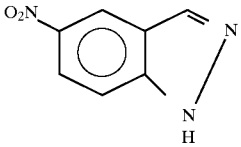
F-5
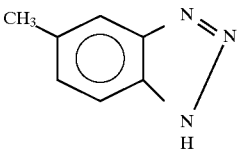
F-6
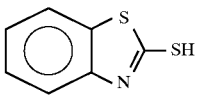

-continued

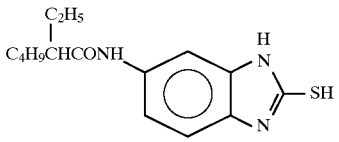

F-7

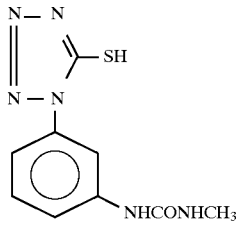

F-8

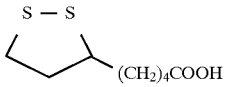

F-9

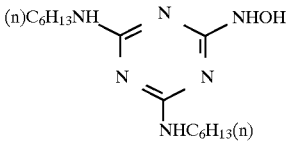

F-10

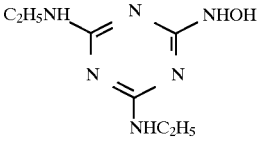

F-11

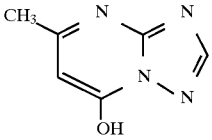

F-12

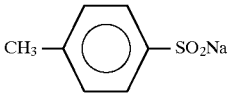

F-13

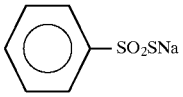

F-14

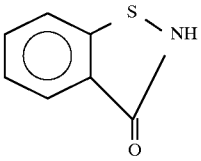

F-15

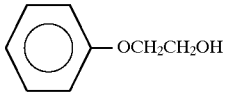

F-16

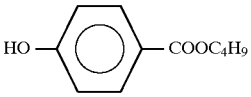

F-17

The properties of emulsions (1) to (7) to be added are summarized in Table 3 below.

TABLE 3

| Emulsion name | Average AgI content (%) | Average grain size (μm) | Variation coefficient (%) relating to grain size | Diameter/ thickness ratio | Silver amount ratio [core/intermediate/shell] (AgI content) | Grain structure/shape |
|---|---|---|---|---|---|---|
| Emulsion (1) | 4.0 | 0.45 | 27 | 1 | [1/3] (13/1) | Double structure octahedral grain |
| Emulsion (2) | 8.9 | 0.70 | 14 | 1 | [3/7] (25/2) | Double structure octahedral grain |
| Emulsion (3) | 2.0 | 0.55 | 25 | 7 | — | Uniform structure tabular grain |
| Emulsion (4) | 9.0 | 0.65 | 25 | 6 | [12/59/29] (0/11/8) | Triple structure tabular grain |
| Emulsion (5) | 9.0 | 0.85 | 23 | 5 | [ 8/59/33] (0/11/8) | Triple structure tabular grain |
| Emulsion (6) | 14.5 | 1.25 | 25 | 3 | [37/63] (34/3) | Double structure tabular grain |
| Emulsion (7) | 1.0 | 0.07 | 15 | 1 | — | Uniform structure fine grain |

In Table 3, (1) The emulsions (1) to (6) were subjected to reduction sensitization during grain preparation by using thiourea dioxide and thiosulfonic acid in accordance with the Examples in JP-A-2-191938.

(2) The emulsions (1) to (6) were subjected to gold sensitization, sulfur sensitization, and selenium sensitization in the presence of the spectral sensitizing dyes indicated in the individual light-sensitive layers and sodium thiocyanate in accordance with the Examples in JP-A-3-237450.

(3) The preparation of tabular grains was performed by using low-molecular weight gelatin in accordance with the Examples in JP-A-1-158426.

(4) Dislocation lines as described in JP-A-3-237450 were observed in tabular grains and regular crystal grains having a grain structure when a high-voltage electron microscope was used.

| | | |
|---|---|---|
| 1st layer (Antihalation layer) | | |
| Black colloidal silver | silver | 0.18 |
| Gelatin | | 1.40 |
| ExM-1 | | 0.18 |
| ExF-1 | | $2.0 \times 10^{-3}$ |
| 2nd layer (Interlayer) | | |
| Emulsion (7) | silver | 0.065 |
| 2,5-di-t-pentadecylhydroquinone | | 0.18 |
| ExC-2 | | 0.020 |
| UV-1 | | 0.060 |
| UV-2 | | 0.080 |
| UV-3 | | 0.10 |
| HBS-1 | | 0.10 |
| HBS-2 | | 0.020 |
| Gelatin | | 1.04 |
| 3rd layer (1st red-sensitive emulsion layer) | | |
| Emulsion (1) | silver | 0.25 |
| Emulsion (2) | silver | 0.25 |
| ExS-1 | | $6.9 \times 10^{-5}$ |
| ExS-2 | | $1.8 \times 10^{-5}$ |
| ExS-3 | | $3.1 \times 10^{-4}$ |
| ExC-1 | | 0.17 |
| ExC-4 | | 0.17 |
| ExC-7 | | 0.020 |
| UV-1 | | 0.070 |
| UV-2 | | 0.050 |
| UV-3 | | 0.070 |
| HBS-1 | | 0.060 |
| Gelatin | | 0.87 |
| 4th layer (2nd red-sensitive emulsion layer) | | |
| Emulsion (4) | silver | 0.80 |
| ExS-1 | | $3.5 \times 10^{-4}$ |
| ExS-2 | | $1.6 \times 10^{-5}$ |
| ExS-3 | | $5.1 \times 10^{-4}$ |
| ExC-1 | | 0.20 |
| ExC-2 | | 0.050 |
| ExC-4 | | 0.20 |
| ExC-5 | | 0.050 |
| ExC-7 | | 0.015 |
| UV-1 | | 0.070 |
| UV-2 | | 0.050 |
| UV-3 | | 0.070 |
| Gelatin | | 1.30 |
| 5th layer (3rd red-sensitive emulsion layer) | | |
| Emulsion D, E, F or G | silver | 1.40 |
| ExS-1 | | $2.4 \times 10^{-4}$ |
| ExS-2 | | $1.0 \times 10^{-4}$ |
| ExS-3 | | $3.4 \times 10^{-4}$ |
| ExC-1 | | 0.097 |
| ExC-2 | | 0.010 |
| ExC-3 | | 0.065 |
| ExC-6 | | 0.020 |
| HBS-1 | | 0.22 |
| HBS-2 | | 0.10 |
| Gelatin | | 1.63 |
| 6th layer (Interlayer) | | |
| Cpd-1 | | 0.040 |
| HBS-1 | | 0.020 |
| Gelatin | | 0.80 |
| 7th layer (1st green-sensitive emulsion layer) | | |
| Emulsion (3) | silver | 0.30 |

-continued

| | | |
|---|---|---|
| ExS-4 | | $2.6 \times 10^{-5}$ |
| ExS-5 | | $1.8 \times 10^{-4}$ |
| ExS-6 | | $6.9 \times 10^{-4}$ |
| ExM-1 | | 0.021 |
| ExM-2 | | 0.20 |
| ExM-3 | | 0.030 |
| ExY-1 | | 0.025 |
| HBS-1 | | 0.10 |
| HBS-3 | | 0.010 |
| Gelatin | | 0.63 |
| 8th layer (2nd green-sensitive emulsion layer) | | |
| Emulsion (4) | silver | 0.55 |
| ExS-4 | | $2.2 \times 10^{-5}$ |
| ExS-5 | | $1.5 \times 10^{-4}$ |
| ExS-6 | | $5.8 \times 10^{-4}$ |
| ExM-2 | | 0.094 |
| ExM-3 | | 0.026 |
| ExY-1 | | 0.018 |
| HBS-1 | | 0.16 |
| HBS-3 | | $8.0 \times 10^{-3}$ |
| Gelatin | | 0.50 |
| 9th layer (3rd green-sensitive emulsion layer) | | |
| Emulsion (5) | silver | 1.55 |
| ExS-4 | | $4.6 \times 10^{-5}$ |
| ExS-5 | | $1.0 \times 10^{-4}$ |
| ExS-6 | | $3.9 \times 10^{-4}$ |
| ExC-1 | | 0.015 |
| ExM-1 | | 0.013 |
| ExM-4 | | 0.065 |
| ExM-5 | | 0.019 |
| HBS-1 | | 0.25 |
| HBS-2 | | 0.10 |
| Gelatin | | 1.54 |
| 10th layer (Yellow filter layer) | | |
| Yellow colloidal silver | silver | 0.035 |
| Cpd-1 | | 0.080 |
| HBS-1 | | 0.030 |
| Gelatin | | 0.95 |
| 11th layer (1st blue-sensitive emulsion layer) | | |
| Emulsion (3) | silver | 0.18 |
| ExS-7 | | $8.6 \times 10^{-4}$ |
| ExY-1 | | 0.042 |
| ExY-2 | | 0.72 |
| HBS-1 | | 0.28 |
| Gelatin | | 1.10 |
| 12th layer (2nd blue-sensitive emulsion layer) | | |
| Emulsion (4) | silver | 0.40 |
| ExS-7 | | $7.4 \times 10^{-4}$ |
| ExC-7 | | $7.0 \times 10^{-3}$ |
| ExY-2 | | 0.15 |
| HBS-1 | | 0.050 |
| Gelatin | | 0.78 |
| 13th layer (3rd blue-sensitive emulsion layer) | | |
| Emulsion (6) | silver | 0.70 |
| ExS-7 | | $2.8 \times 10^{-4}$ |
| ExY-2 | | 0.20 |
| HBS-1 | | 0.070 |
| Gelatin | | 0.69 |
| 14th layer (1st protective layer) | | |
| Emulsion (7) | silver | 0.20 |
| UV-4 | | 0.11 |
| UV-5 | | 0.17 |
| HBS-1 | | $5.0 \times 10^{-2}$ |
| Gelatin | | 1.00 |
| 15th layer (2nd protective layer) | | |
| H-1 | | 0.40 |
| B-1 (diameter 1.7 $\mu$m) | | $5.0 \times 10^{-2}$ |
| B-2 (diameter 1.7 $\mu$m) | | 0.10 |
| B-3 | | 0.10 |
| S-1 | | 0.20 |
| Gelatin | | 1.20 |

In addition to the above components, to improve storage stability, processability, a resistance to pressure, antiseptic and mildewproofing properties, antistatic properties, and coating properties, each layer contained W-1, W-2, W-3, B-4, B-5, B-6, F-1, F-2, F-3, F-4, F-5, F-6, F-7, F-8, F-9, F-10, F-11, F-12, F-13, F-14, F-15, F-16, F-17, iron salt, lead salt, gold salt, platinum salt, iridium salt, and rhodium salt.

The samples 301 to 304 thus obtained were exposed and processed by the method described below.

Processing Method

| Process | Time | Temperature |
|---|---|---|
| Color development | 3 min. 15 sec. | 38° C. |
| Bleaching | 1 min. 00 sec. | 38° C. |
| Bleach-fixing | 3 min. 15 sec. | 38° C. |
| Washing (1) | 40 sec. | 35° C. |
| Washing (2) | 1 min. 00 sec. | 35° C. |
| Stabilization | 40 sec. | 38° C. |
| Drying | 1 min. 15 sec. | 55° C. |

The compositions of each processing solution are given below.

| | (g) |
|---|---|
| (Color developing solution) | |
| Diethylenetriaminepentaacetic acid | 1.0 |
| 1-hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-[N-ethyl-N-β-hydroxylethylamino]-2-methylaniline sulfate | 4.5 |
| Water to make | 1.0 l |
| pH | 10.05 |
| (Bleaching solution) | |
| Ferric ammonium ethylenediamine-tetraacetate dihydrate | 120.0 |
| Disodium ethylenediaminetetraacetate | 10.0 |
| Ammonium bromide | 100.0 |
| Ammonium nitrate | 10.0 |
| Bleaching accelerator represented by formula below | 0.005 mole |
| Ammonia water (27%) | 15.0 ml |
| Water to make | 1.0 l |
| pH | 6.3 |
| Bleaching accelerator | |

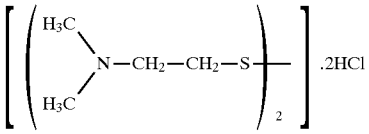

| | |
|---|---|
| (Bleach-fixing solution) | |
| Ferric ammonium ethylenediamine-tetraacetate dihydrate | 50.0 |
| Disodium ethylenediaminetetraacetate | 5.0 |
| Sodium sulfite | 12.0 |
| Ammonium thiosulfate aqueous solution (70%) | 240.0 ml |
| Ammonia water (27%) | 6.0 ml |
| Water to make | 1.0 l |
| pH | 7.2 |

(Washing solution)

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/l or less. Subsequently, 20 mg/l of sodium isocyanuric acid dichloride and 0.15 g/l of sodium sulfate were added. The pH of the solution fell within the range of 6.5 to 7.5.

| (Stabilizing solution) | (g) |
|---|---|
| Formalin (37%) | 2.0 ml |
| Polyoxyethylene-p-monononylphenylether (average polymerization degree = 10) | 0.3 |
| Disodium ethylenediaminetetraacetate | 0.05 |
| Water to make | 1.0 l |
| pH | 5.0–8.0 |

The sensitivity was evaluated in terms of the logarithm (relative value assuming that the sample 302 is 100) of the reciprocal of an exposure amount at which a density of lowest cyan density+0.2 is given.

TABLE 4

| Sample No. | Emulsion in 5th layer | Sensitivity | Fog | Remarks |
|---|---|---|---|---|
| 301 | D | 110 | 0.20 | Comparative example |
| 302 | E | 100 | 0.15 | Comparative example |
| 303 | F | 120 | 0.17 | Present invention |
| 304 | G | 102 | 0.15 | Comparative example |

Table 4 reveals that the emulsions of the present invention maintained high sensitivities and had an effect of suppressing fog even in the color multilayered coated sample, as in Example 1.

As has been described above, according to the present invention, there is provided silver halide emulations having high sensitivities and capable of fog.

What is claimed is:

1. A silver halide emulsion containing silver halide grains comprising:

tabular silver iodobromide grains having dislocation lines on fringe portions of the grains and an average aspect ratio of 3 to 6.5, as host grains, wherein said dislocation lines were introduced by forming a silver iodide-rich phase inside the tabular silver halide grain, and a silver halide consisting essentially of silver bromide, disposed, as a guest, only at the corners of said host grains by epitaxial growth, wherein the pAg value was 7 to 10 and the temperature was 40° C. to 70° C. during said epitaxial growth, $5\times10^{-5}$ to $2\times10^{-3}$ mole/mole of Ag of a spectral sensitizing dye was added before said epitaxial growth of the guest was performed, and the amount of each of $AgNO_3$ and halide added during said epitaxial growth was 0.01–5 mole % with respect to the silver of the host grains.

2. The emulsion according to claim 1, wherein said host grains are hexagonal tabular silver halide grains having six substantially equal sides.

3. The emulsion according to claim 1, wherein an average iodide content of said host is 1 to 30 mole %.

* * * * *